US010697609B2

(12) United States Patent
Schaefer et al.

(10) Patent No.: US 10,697,609 B2
(45) Date of Patent: Jun. 30, 2020

(54) SHRINK FIT FASTENING OF HEAT SINK AND LIGHT SOURCE CARRIER

(71) Applicant: HELLA GmbH & Co. KGaA, Lippstadt (DE)

(72) Inventors: Heinrich Schaefer, Bad Wuennenberg (DE); Janis Schaefer, Bad Wuennenberg (DE); Robin Schaefer, Bad Wuennenberg (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/014,663

(22) Filed: Jun. 21, 2018

(65) Prior Publication Data

US 2018/0372297 A1 Dec. 27, 2018

(30) Foreign Application Priority Data

Jun. 21, 2017 (DE) ..... 10 2017 113 673

(51) Int. Cl.

| | |
|---|---|
| ***F21S 43/00*** | (2018.01) |
| ***F21S 43/247*** | (2018.01) |
| ***F21S 43/14*** | (2018.01) |
| ***F21S 45/48*** | (2018.01) |
| ***F21S 43/27*** | (2018.01) |
| ***F21S 43/237*** | (2018.01) |
| ***F21S 43/19*** | (2018.01) |
| ***F21S 45/47*** | (2018.01) |
| ***F21S 41/141*** | (2018.01) |
| ***F21S 45/49*** | (2018.01) |
| ***F21S 41/19*** | (2018.01) |
| ***F21S 41/29*** | (2018.01) |

(52) U.S. Cl.

CPC ..... *F21S 43/247* (2018.01); *F21S 41/141* (2018.01); *F21S 41/192* (2018.01); *F21S 41/29* (2018.01); *F21S 43/14* (2018.01); *F21S 43/195* (2018.01); *F21S 43/237* (2018.01); *F21S 43/27* (2018.01); *F21S 45/47* (2018.01); *F21S 45/48* (2018.01); *F21S 45/49* (2018.01)

(58) Field of Classification Search

CPC ..... F21S 45/49; F21S 43/19

See application file for complete search history.

(56) References Cited

U.S. PATENT DOCUMENTS

| | | | | |
|---|---|---|---|---|
| 7,905,632 | B2 | 3/2011 | Dobler et al. | |
| 9,528,680 | B2 | 12/2016 | Zorn | |
| 2008/0298058 | A1* | 12/2008 | Kan | F21V 15/01 362/240 |
| 2010/0302777 | A1* | 12/2010 | Knoll | F21V 17/06 362/235 |

(Continued)

FOREIGN PATENT DOCUMENTS

| | | | |
|---|---|---|---|
| AT | 514048 | A1 | 9/2014 |
| DE | 102007049310 | A1 | 4/2009 |

(Continued)

*Primary Examiner* — Gerald J Sufleta, II

(74) *Attorney, Agent, or Firm* — Muncy, Geissler, Olds & Lowe, P.C.

(57) ABSTRACT

A lighting device for vehicles with a plurality of components to be connected, having a light source, a light source carrier, an optical element and a heat sink. The heat sink is connected by a fastener to the light source carrier. The fastener is a shrink-fitting agent.

10 Claims, 2 Drawing Sheets

(56) References Cited

U.S. PATENT DOCUMENTS

| | | | | |
|---|---|---|---|---|
| 2012/0227889 | A1* | 9/2012 | Schmitt | F16B 11/006 156/66 |
| 2013/0301273 | A1* | 11/2013 | Chu | F21V 29/70 362/294 |
| 2015/0260376 | A1* | 9/2015 | Joo | F21V 5/007 362/235 |
| 2016/0084460 | A1* | 3/2016 | Kolstee | F21S 41/336 362/516 |
| 2016/0146404 | A1* | 5/2016 | Kim | F21V 29/70 362/294 |
| 2017/0248287 | A1* | 8/2017 | Yasuda | B60Q 1/0041 |
| 2017/0289420 | A1* | 10/2017 | Reiche | H04N 5/2253 |

FOREIGN PATENT DOCUMENTS

| | | | |
|---|---|---|---|
| DE | 102013009146 | A1 | 12/2014 |
| DE | 102015105283 | A1 | 10/2016 |
| DE | 102015207709 | A1 | 10/2016 |
| DE | 102015117936 | A1 | 4/2017 |
| EP | 2312204 | A1 | 4/2011 |

* cited by examiner

SHRINK FIT FASTENING OF HEAT SINK AND LIGHT SOURCE CARRIER

This nonprovisional application claims priority under 35 U.S.C. § 119(a) to German Patent Application No. 10 2017 113 673.8, which was filed in Germany on Jun. 21, 2017, and which is herein incorporated by reference.

BACKGROUND OF THE INVENTION

Field of the Invention

The invention relates to a lighting device for vehicles with a plurality of components to be connected, comprising a light source, a light source carrier, an optical element and a heat sink, wherein a first component is connected by way of a fastener to a second component at a fastening point, and wherein the first component and the second component have different thermal expansion properties. Furthermore, the invention relates to a method for fastening flat components of a lighting module, which includes a light source carrier, an optical element and a heat sink as components of a light source, wherein a first component is applied with a flat side to a flat side of a second component and is brought to a fastening state at a fastening point by means of a fastener.

Description of the Background Art

From DE 10 2016 105 283 A1, a lighting device for vehicles is known, which comprises as components a light source, a printed circuit board and an optical element formed as a light guide for generating a predetermined light distribution. To fasten the light source carrier to the light guide, a holder is provided in which a portion of the holder is connected by means of a helical fastener with the light source carrier.

In the conventional art, however, a selective introduction of force thus produced leads to undesirable component stresses. If at least one of the components to be joined is formed of a plastic, there is a risk that the plastic material may relax. The concomitant plastic deformation of the plastic material leads to a delay, which leads to an undesirable change in the light range when connecting a light source carrier as the first component and an optical element as the second component. This can lead to oncoming road users being blinded, which is to be avoided for reasons of traffic safety. In particular, when a lens-shaped optical element, for example, is to be fastened directly on the light source carrier, undesired stresses can occur. This is due in particular to the different thermal conductivity coefficients of the materials of which the light source carrier and optical element are made. If the first component and the second component are connected, for example, by riveting or screwing, as a rule, a gap is created between the components to be connected.

In order to improve the heat conduction, the gap between the components facing each other can be filled with a heat-conducting layer, for example with a thermal compound. From EP 2 312 204 B1, a lighting device with a thermoadhesive layer is provided between a light source carrier and a heat sink in order to improve the transfer of heat in the direction of the heat sink and thus towards the outside environment. A disadvantage of the known lighting device is that unwanted stresses occur due to the selective introduction of force, and that a plurality of joining processes are necessary to mount the lighting device.

SUMMARY OF THE INVENTION

It is therefore an object of the present invention to provide a lighting device for vehicles and a method for attaching flat components of a lighting module such that the assembly can be simplified and made more efficient, wherein the fastening of the components can be designed in particular low-stress or stress-free.

To solve this problem, in an exemplary embodiment of the invention, a shrink-fitting agent is provided as a fastener, which in a mounting state of said agent exerts a fixing force which compresses joining surfaces of the first component and of the second component.

According to the invention, a shrink-fitting agent is provided as the fastener, which alone due to the shrinkage of the same exerts a fixing force, which compresses the joining surfaces of the first component and the second component. According to the invention, the shrinkage behavior or the emergence of shrinkage forces of the joining agent is used specifically for fixing the components to be joined together. The material of the components to be joined is less loaded, since a constant shrinkage force is created along the joining surfaces of the first and second component. Advantageously, a low-stress or stress-free connection can be generated between the first component and the second component. Heat transfer from the first component to the second component can be omitted if the fastening points are spatially limited. The direct flat contact between the first component and the second component increases the effectiveness of the cooling performance.

The fixing force acting on the first component and the second component can be adjusted or metered as a function of a dimensioning, position and/or degree of shrinkage of the shrink-fitting agent. If, for example, a relatively thick shrink-fitting agent is provided, this creates higher shrinkage forces than a relatively thin shrink-fitting agent so that, for example, the number of fastening points can be reduced.

The shrink-fitting agent can have a thickness extending transversely to the joining surfaces of the first and second component and a length extending in the direction of the joining surfaces of the same. The fact that the thickness of the shrink-fitting agent is always less than the length thereof, ensures that the fixing force is directed mainly transversely toward the joining surfaces of the first and second component.

A plurality of fastening points can be arranged distributed over the surface of the first and/or second component. In comparison to a screw and rivet connection, the fixation can virtually be at any point of the components, since neither the first nor the second component are perforated by the shrink-fitting agent. When the shrink-fitting agent is positioned in a recess of the first and/or second component, the first and the second component lie flat against one another in the fixing position.

The shrink-fitting agent can be designed as a cohesive joining agent and/or as an adhesive. Advantageously, the shrink-fitting agent can be activated as an adhesive by light and/or heat, so that additionally, a force effect due to the shrinkage accompanies the adhesive effect due to bonding.

The first and/or second component of a fastening point can have a recess for receiving the shrink-fitting agent. If the shrink-fitting agent fills only the recess, wherein an approximately flush fit to the joining surface is present in adjacent areas, the first component can be fixed to the second component with planar contact of abutment surfaces thereof. In addition, the joining surface is enlarged by providing a recess, which leads to an increase in the fixing force.

A holder for fixing a first component to a second component can be provided. The holder has a first fastening portion which is connected to the first component by means of the shrink-fitting agent. Furthermore, the holder has a second fastening portion which acts with a pressure surface on the second component in the activation state of the shrink-fitting agent. Advantageously, this ensures a floating mounting of the second component relative to the first component.

The shrink-fitting agent can be brought into the activation state by means of light and/or heat. Advantageously, this allows the force effect to be spatially independent of the fastening point.

Further, prior to juxtaposition of the first component to the second component, a shrink-fitting agent is applied to a joining surface of the first component and/or the second component which is arranged as a fastener at the fastening point, that the first component is brought into a mounting position relative to the second component and that then, the shrink-fitting agent is activated such that a fixing force acts on the joining surfaces and/or flat sides of the first component and the second component.

An advantage of the method according to the invention is that the fastening can take place in relatively few steps. The invention enables a direct connection between a first component and a second component without an intermediate layer, wherein a heat transfer between the components is not affected. This can advantageously be used to provide a layered assembly, so that a lighting module with several components arranged one above the other can be created.

A first component can be connected to a second component by means of a holder, wherein the holder is connected to the first component by means of the shrink-fitting agent. The fixing force generated by the shrink-fitting agent acts on a second fastening portion of the holder, so that this fixing force acts on the second component and presses this against the first component, or the first component is clamped against the second component. In this way, in particular, a floating mounting of the second component can be ensured relative to the first component.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A lighting device for vehicles has a housing which is closed in the main emission direction H at the front by means of a translucent cover plate. The lighting device can be arranged, for example, in the front and/or rear area of a vehicle. In the housing of the lighting device, a plurality of lighting modules may be provided, each having a light source and an optical element, for example, a primary and secondary optical element.

The optical elements may be formed as reflectors, optical fibers, lenses or the like. The optical elements serve to shape or deflect the light emitted by a light source 1 in such a way that a predetermined light distribution, for example, a low-beam light distribution, is generated.

Figure 1:
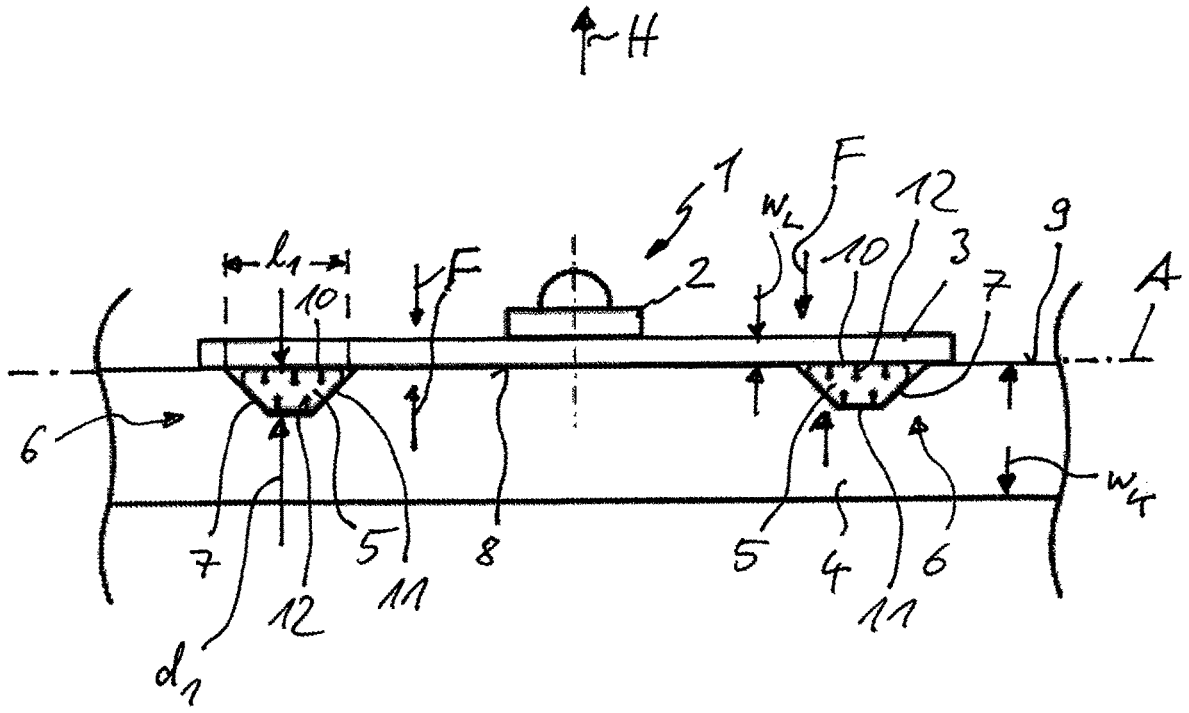
FIG. 1 is a vertical section through a first lighting device, wherein a light source carrier is connected to a heat sink by means of shrink-fitting agents.

A lighting device shown in FIG. 1 may be integrated in such a lighting module, wherein in the main emission direction H in front of the light source 1, an optical element, such as a lens, is arranged.

The light source 1 is designed as a semiconductor-based light source, in particular as an LED light source, wherein, for example, one or more light-generating elements can be arranged on a chip 2. The light source 1 is usually attached to a light source carrier 3 formed as a printed circuit board. The circuit board 3 may be rigid or flexible. Optionally, further electrical components, in particular control components for the lighting device, can be arranged on the circuit board 3.

On a side facing away from the light source 1, the light source carrier 3 is connected to a heat sink 4 by a fastener. The heat sink 4 is made of a heat conductive metal material or metal composite material. The light source carrier 3 is designed as a printed circuit board and is formed of, for example, of a glass fiber fabric, for example, glass fiber mats impregnated with epoxy resin, paper fiber or metal substrates. A first component embodied as a heat sink 4 thus has different thermal expansion properties than a second component 3 designed as a light source carrier 3.

At fastening points 6 in cross section, the heat sink 4 has prism-shaped or rectangular or trough-shaped recesses 7 for receiving the fastener 5 which are designed as a shrink-fitting agent.

In a fastening state of the shrink-fitting agent 5, in which the heat sink 4 is integrally connected to the light source carrier 3, the light source carrier 3 is located on a flat side 9 of the heat sink 4 with a flat side 8 facing away from the light source 1 in a planar manner. The flat sides 8, 9 are preferably planar.

The shrink-fitting agent 5 is designed as a cohesive joining agent, in particular as an adhesive, which has a relatively high degree of shrinkage. In an initial state, the shrink-fitting agent 5 is liquid or viscous. It is in a non-fastening state. To bring the shrink-fitting agent 5 from the non-fastening state to the fastening state, the shrink-fitting agent 5 is acted upon by heat and/or pressure. By activating the shrink-fitting agent 5, on the one hand, the latter adheres to joining surfaces 10, 11 of the light source carrier 3 or the heat sink 4. On the other hand, shrinkage forces 12, which exert an additional fixing force F acting on the joining surfaces 10, 11, are produced in the shrink-fitting agent 5.

The fixing force F causes compression of the heat sink 4 and the light source carrier 3, wherein a gap present in the non-fastening state between the flat side 8 of the light source carrier 3 and the flat side 9 of the heat sink 4 disappears. In the fastening state, the flat side 8 of the light source carrier 3 and the flat side 9 of the heat sink 4 abut one another in a flat manner without gaps, namely in a contact plane A.

Depending on the dose of the shrink-fitting agent 5 and/or the dimensioning of the recess 7 and/or the degree of shrinkage of the shrink-fitting agent 5, the fixing force F can be adjusted or changed. The larger the joining surfaces 10, 11, the greater the fixing force F. In order for the shrinkage forces 12 to be directed mainly perpendicular to the flat sides 8, 9 of the light source carrier 3 or heat sink 4, the thickness $d_1$ of the shrink-fitting agent 5 is less than the length $I_1$ thereof. Preferably, the length $I_1$ of the shrink-fitting agent 5 or the recess 7 is more than three times the thickness $d_1$ of the shrink-fitting agent 5 or the recess 7. Preferably, the length $I_1$ of the shrink-fitting agent 5 or the recess 7 is less than five times the thickness $d_1$ of the shrink-fitting agent 5 or the recess 7.

The recess 7 of the heat sink 4 may be formed lens-shaped, so that a plurality of fastening points 6 are preferably distributed in corner regions of the light source carrier 3. According to an alternative embodiment of the invention, the fastening points 6 may be formed linear instead of as dots.

In the exemplary embodiment according to FIG. 1, the thickness $d_1$ of the shrink-fitting agent 5 is greater than half the wall thickness of the light source carrier 3. For example, the thickness $d_1$ of the shrink-fitting agent 5 can be greater than the wall thickness w of the light source conductor $w_L$ and less than a wall thickness $w_K$ of the heat sink 4. In the present embodiment, the thickness $d_1$ of the shrink-fitting agent 5 is less than twice the wall thickness $w_L$ of the light source carrier 3.

Figure 2:
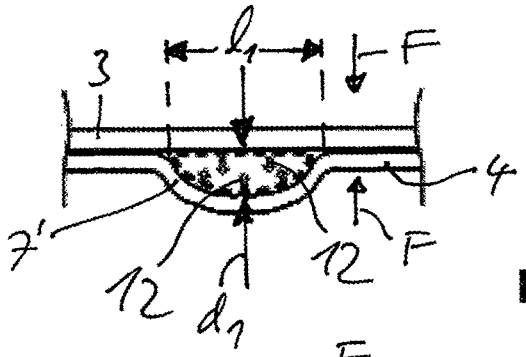
FIG. 2 is a vertical section at a fastening point of the lighting device according to FIG. 1 with an alternative geometry of the components or shrink-fitting agent to be joined.

In the exemplary embodiment according to FIG. 2, a recess 7' may be formed as a hollow sphere instead of a truncated pyramid or a truncated cone like the recess 7 of FIG. 1.

Figure 3:
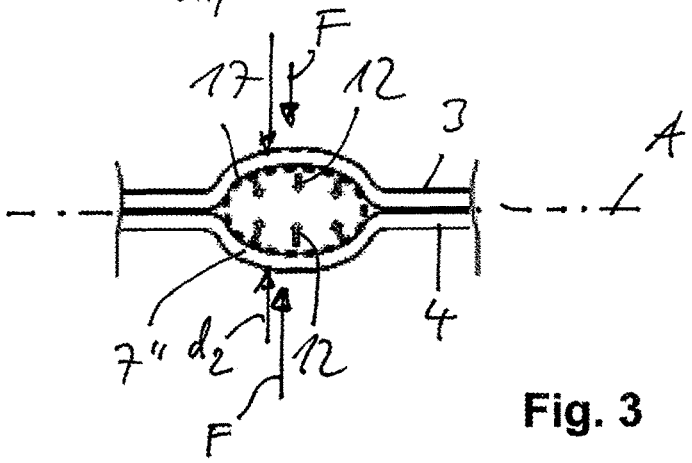
FIG. 3 is a vertical section through a fastening point, in which both components to be connected have hollow recesses which are filled by an ellipsoidal shrink-fitting agent.

In the exemplary embodiment according to FIG. 3, not only can the heat sink 4 have a recess 7", but the light source carrier 3 can also have a recess 17. The two recesses 7" and 17 run symmetrical to the contact plane A, so that the shrinkage forces 12 of the shrink-fitting agent 5 act evenly distributed on the joining surfaces 10, 11 of the light source carrier 3 or the heat sink 4. A thickness $d_2$ of the shrink-fitting agent 5 is substantially greater than the thickness $d_1$ according to the embodiment of FIG. 1 and FIG. 2. Therefore, in comparison to the embodiment of FIG. 2, the fixing force F is much greater, that is, the joining surfaces 10, 11 are pressed together stronger so that a comparatively higher fixing force acts on the same. The contact plane A forms an interface between the light source carrier 3 and the heat sink 4.

It becomes clear that, depending on the configuration or arrangement of the fastening point 6 and/or shaping of the fastening point 6 for receiving the shrink-fitting agent 5 and/or composition of the shrink-fitting agent 5, the fixing force F acting on the components 3, 4 to be joined is adjustable or controllable. The fixing force F can thus be set or varied as a function of a plurality of different parameters.

Figure 4:
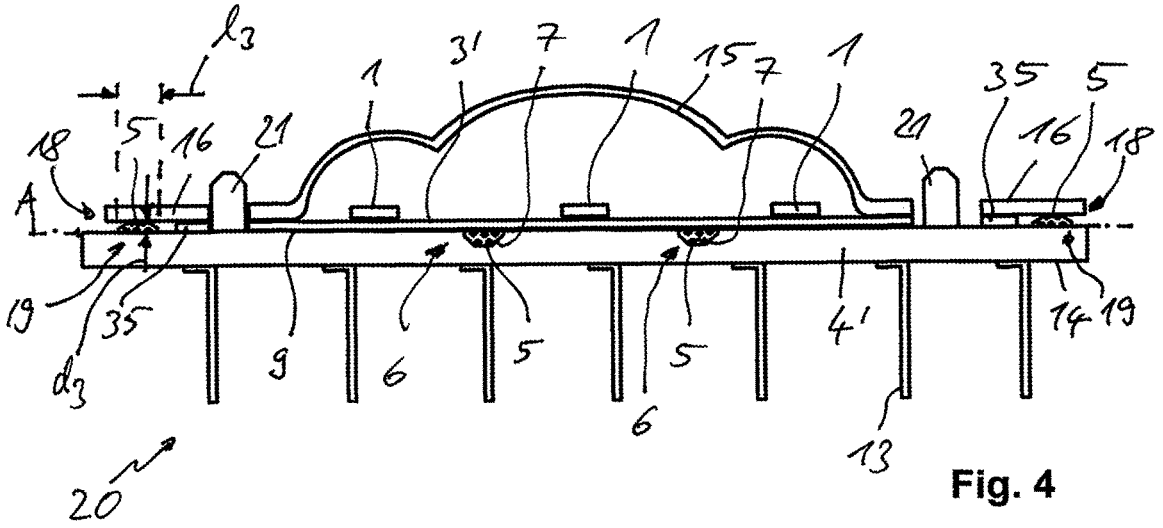
FIG. 4 is a vertical section through an alternative lighting device, in which at fastening points, on the one hand, the light source carrier is connected to the heat sink and on the other, an optical element is connected to said heat sink.

In the exemplary embodiment according to FIG. 4, a lighting module 20 is provided which serves to generate a light distribution, for example a low-beam light distribution. The lighting module 20 is mounted in a housing, which is closed by a transparent cover. The lighting module 20 has a plurality of light sources 1, which are arranged on a common light source carrier 3'. As in accordance with the lighting device according to FIG. 1, the light source carrier 3' is cohesively connected to a heat sink 4' at the fastening points 6 by means of the shrink-fitting agent 5. For this purpose, the heat sink 4' has the conical-shaped recesses 7. In addition, the heat sink 4' has cooling fins 13 on a side facing away from the light source carrier 3', which protrude from a flat side 14 of the heat sink 4'. The flat side 14 is arranged on a side of the heat sink 4' facing away from the light source carrier 3'.

For the additional fastening of an optical element 15 to the heat sink 4', the optical element 15 has flat edge tabs 16 in an outer edge portion which lie flat on an edge 35 of the light source carrier 3' on the same. A gap 18 forms between the edge tabs 16 of the optical element 15 and the edge 35 of the light source carrier 3', which is at least partially filled with the shrink-fitting agent 5.

The fastening of the lighting module 20 is done in a layered manner of mounting. First, the heat sink 4' is placed on a tool carrier. Subsequently, the recesses 7 of the heat sink 4' are filled with the shrink-fitting agent 5. Such an amount of shrink-fitting agent 5 is applied that it rests flush against the flat side 9 of the heat sink 4'. Subsequently, the light source carrier 3' equipped with the light sources 1 is placed on the heat sink 4'. Optionally, with the application of the shrink-fitting agent 5 into the recesses 7, the former can already be selectively applied to an edge portion 19 of the heat sink 4'. Due to the viscosity of the shrink-fitting agent 5, this will spread only to a limited extent in the direction of the contact plane A. A limited distribution in the direction of the contact plane A of the shrink-fitting agent 5 is even desired, so that the thickness $d_3$ of the dab of shrink-fitting agent is smaller than a length $I_3$ thereof. Alternatively, the application of the shrink-fitting agent 5 to the edge portion 19 can also take place after the optical element 15 has been placed on the light source carrier 3'. After the optical element 15 has been placed on the support plate 3', and possibly causes a further extension of the shrink-fitting agent 5 in the edge portion 19 of the heat sink 4' due to its own weight, the shrink-fitting agent 5 can be activated by introduction of heat and/or light, or can be brought from the non-fastening state to the fastening state.

Positioning pins 21 protrude from the heat sink 4' for precise positioning of the light source carrier 3' or the optical element 15 relative to the heat sink 4'.

Figure 5:
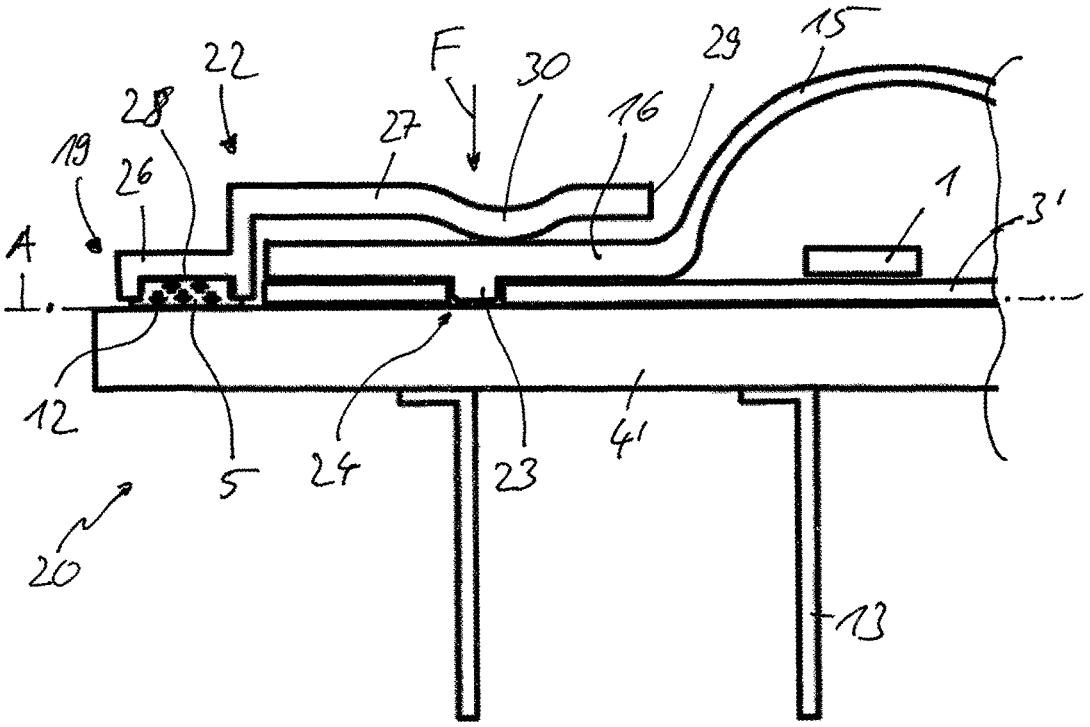
FIG. 5 is a partial vertical section through a lighting device according to a further embodiment of the invention in which the optical element or the light source carrier is attached to the heat sink via a holder.

In the exemplary embodiment according to FIG. 5, in contrast to the embodiment according to FIG. 4, the optical element 15 is fastened to the heat sink 4' by means of a holder 22. In contrast to the embodiment according to FIG. 4, the optical element 15 has a pin 23, which protrudes from the edge tab 16 on a side facing the light source carrier 3' and in the assembly position, engages in an opening 24 of the light source carrier 3'. After placing the optical element 15 on the light source carrier 3', the former is thus fixed in the direction of the contact plane A. To fix the optical element 15 and the light source carrier 3' in height, i.e., transverse to the contact plane A, the holder 22 has a first fastening portion 26 and a second fastening portion 27, wherein the first fastening portion 26 is disposed outside the light source carrier 3' or the optical element 15, and the second fastening portion 27 is arranged in the region of the edge tab 16 of the optical element 15. Preferably, the holder 22 is frame-shaped, which continuously surrounds the lighting module 20 on the edge side.

The first fastening portion 26 has a recess 28 for receiving or enclosing the shrink-fitting agent 5. Upon activation or curing of the shrink-fitting agent 5, a material connection between the holder 22 and the heat sink 4' takes place in the first fastening portion 26 of the holder 22. Upon activation of the shrink-fitting agent 5, the fixing force F is generated, which also acts on the second fastening portion 27 due to the integral connection between the first fastening portion 26 and the second fastening portion 27. The second fastening portion 27 has a free end 29 on a side facing away from the first fastening portion 26. The second fastening portion 27 is formed spring-like with a dented element 30, which points from the plane of extension of the second fastening portion 27 downward or in the direction of the edge tab 16 of the optical element 15, and presses on said tab as a pressure surface in the fastening state. As a result, there is a quasi-linear or punctiform force F of the holder 22 on the optical element 15. A vertical fixation of the optical element 15 and the light source carrier 3', or a fixation perpendicular to the plane A, is thus provided.

Before the shrink-fitting agent 5 is activated at the edge portion 19 of the heat sink 4', a compensating movement of the already positively connected light source carrier optical element assembly having a light source carrier 3' and optical element 15 takes place in the direction of the contact plane A. In the manufacturing process, thus, a voltage compensation can take place, for example by means of thermal expansion, since the assembly having the light source carrier 3' and optical element 15 is floatingly mounted.

The holder 22 is preferably made of a plastic material, wherein the second fastening portion 27 is formed longer than the first fastening portion 26. Due to its length, the second fastening portion 27 has a limited spring action, such that with a small deflection of the second fastening portion 27, there is no break relative to the first fastening portion 26.

According to an alternative embodiment of the invention, the pin 23 may also be formed longer, so that it engages in a recess of the heat sink 4'. A floating mounting of the assembly having the light source carrier 3' and optical element 15 then no longer applies.

In the embodiment according to FIG. 5, a direct cohesive connection between the light source carrier 3' and the heat sink 4'—contrary to the embodiment according to FIG. 4—is not necessary.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting device for vehicles having at least two building components to be connected, the lighting device comprising:

a light source;

a light source carrier;

an optical element; and a heat sink, wherein the heat sink is connected by a fastener to the light source carrier at a fastening point, the fastening point directly fastening the light source carrier and the heat sink together, wherein the heat sink and the light source carrier have different thermal expansion properties, wherein the fastener is a shrink-fitting agent, which in a fastening state of the shrink-fitting agent exerts a fixing force that compresses joining surfaces of the heat sink and the light source carrier, and wherein the shrink-fitting agent has a thickness at the fastening point that extends transversely to the joining surfaces of the heat sink and of the light source carrier, which is smaller than a length extending in a direction of the joining surfaces of the heat sink and the light source carrier.

2. The lighting device according to claim 1, wherein the fixing force of the shrink-fitting agent is adjustable as a function of a dimensioning of the shrink-fitting agent and/or a degree of shrinkage of the shrink-fitting agent and/or from a position of the fastening point relative to the heat sink and the light source carrier.

3. The lighting device according to claim 1, wherein a plurality of the fastening point are provided and are arranged distributed over an extension plane of the heat sink and the light source carrier.

4. The lighting device according to claim 1, wherein the shrink-fitting agent is formed as a cohesive joining agent and/or as an adhesive.

5. The lighting device according to claim 1, wherein the heat sink and/or the light source carrier has a recess at the fastening point for receiving the shrink-fitting agent.

6. A lighting device for vehicles having at least two building components to be connected, the lighting device comprising:

a light source;

a light source carrier;

an optical element;

a heat sink; and a holder, wherein the heat sink is connected by a fastener to the holder at a fastening point, wherein the fastener is a shrink-fitting agent, which in a fastening state of the shrink-fitting agent exerts a fixing force that compresses joining surfaces of the heat sink and the light source carrier, and wherein the holder has a first fastening portion for fixing the holder on the heat sink via the shrink-fitting agent at the fastening point and has a second fastening portion for fixing the holder on the optical element, wherein the second fastening portion has a dented element, which in the fastening state presses on an edge tab of the optical element, and wherein the optical element is positively connected to the light source carrier in a direction extending substantially perpendicular to the fixing force, such that the fixing force compresses the joining surfaces of the heat sink and the light source carrier.

7. The lighting device according to claim 1, wherein the shrink-fitting agent is adapted to be brought from a non-fastening state to the fastening state, in which the heat sink and the light source carrier are firmly connected via light and/or heat.

8. A method for fastening flat components of a lighting module, which has a light source carrier, an optical element, and a heat sink as components of a light source, the method comprising:

applying a flat side of the heat sink to a flat side of the light source carrier;

bringing the heat sink and the light source carrier into a fastening state at a fastening point, the fastening point directly fastening the light source carrier and the heat sink together;

applying a shrink-fitting agent to the fastening point, prior to a juxtaposition of the heat sink to the light source carrier;

moving the heat sink to an assembly position relative to the light source carrier; and activating the shrink-fitting agent such that a fixing force acts on and compresses joined surfaces of the heat sink and the light source carrier, wherein the shrink-fitting agent has a thickness at the fastening point that extends transversely to the joining surfaces of the heat sink and of the light source carrier, which is smaller than a length extending in a direction of the joining surfaces of the heat sink and the light source carrier.

9. The lighting device according to claim 1, wherein an edge tab of the optical element and the heat sink are connected by the shrink-fitting agent at a second fastening point.

10. A method for fastening flat components of a lighting module, which has a light source carrier, an optical element, a heat sink and a holder as components of a light source, the method comprising:

applying a flat side of the heat sink to a flat side of the light source carrier;

bringing the heat sink and the holder into a fastening state at a fastening point;

applying a shrink-fitting agent to the fastening point, prior to a juxtaposition of the heat sink to the holder;

moving the heat sink to an assembly position relative to the holder; and activating the shrink-fitting agent such that a fixing force acts on and compresses joined surfaces of the heat sink and the light source carrier, and wherein the heat sink is connected to a first fastening portion of the holder via the shrink-fitting agent at the fastening point, wherein, after activation of the shrink-fitting agent, a second fastening portion of the holder, that is fixedly connected to the first fastening portion, presses with the fixing force on an edge tab of the optical element and the light source carrier disposed below the edge tab of the optical element, such that the fixing force acts on and compresses the joined surfaces of the heat sink and the light source carrier.

* * * * *